US007784225B2

(12) United States Patent
Kemeny

(10) Patent No.: US 7,784,225 B2
(45) Date of Patent: Aug. 31, 2010

(54) ISOLATION PLATFORM

(75) Inventor: Zoltan A. Kemeny, Tempe, AZ (US)

(73) Assignee: Worksafe Technologies, Valencia, CA (US)

( * ) Notice: Subject to any disclaimer, the term of this patent is extended or adjusted under 35 U.S.C. 154(b) by 664 days.

(21) Appl. No.: 10/522,211

(22) PCT Filed: Jul. 15, 2003

(86) PCT No.: PCT/IS03/21930

§ 371 (c)(1),
(2), (4) Date: Apr. 4, 2006

(87) PCT Pub. No.: WO2004/007871

PCT Pub. Date: Jan. 22, 2004

(65) Prior Publication Data

US 2006/0260221 A1 Nov. 23, 2006

Related U.S. Application Data

(60) Provisional application No. 60/396,228, filed on Jul. 15, 2002.

(51) Int. Cl.
*E04B 1/98* (2006.01)

(52) U.S. Cl. ..... 52/167.1; 52/167.5

(58) Field of Classification Search ..... 52/167.1, 52/167.4, 167.5; 14/73.5; 384/36, 610, 49
See application file for complete search history.

(56) References Cited

U.S. PATENT DOCUMENTS

| | | | | |
|---|---|---|---|---|
| 99,973 | A | 2/1870 | Touaillon | |
| 879,595 | A | 2/1908 | Smith | |
| 951,028 | A | 3/1910 | Schar | |
| 1,761,659 | A | 6/1930 | Cummings | |
| 1,761,660 | A * | 6/1930 | Cummings | 52/167.5 |
| 2,014,643 | A * | 9/1935 | Bakker | 384/49 |

(Continued)

FOREIGN PATENT DOCUMENTS

| | | |
|---|---|---|
| JP | 10-068443 | 3/1998 |

(Continued)

OTHER PUBLICATIONS

Patent Abstract of Japan—Japanese Patent No. JP 10-068443 published Mar. 10, 1998 (English translation).

(Continued)

*Primary Examiner*—Basil Katcheves
(74) *Attorney, Agent, or Firm*—Stout Uxa, Buyan & Mullins LLP; Carlos Fisher; Frank J. Uxa

(57) ABSTRACT

The present invention provides a platform for supporting various equipment and/or structure which assists in isolating such structure from vibrations ("noise") external to the platform. Generally, the platform comprises upper and lower plates, having conical depressions, upon which the upper plate supports the above-mentioned structure, and the lower plate contacting surface/area upon which the supported structure otherwise would have rested. Between the upper and lower plates, a plurality of rigid, spherical bearings are placed within the conical depressions, thereby allowing the upper and lower plates to displace relative to one another. Additionally, the platform may be provided with retaining mechanisms for holding the structure to be supported, maintaining the plates together and providing additional damping effects.

23 Claims, 7 Drawing Sheets

U.S. PATENT DOCUMENTS

| | | | | | |
|---|---|---|---|---|---|
| 2,055,000 | A | | 9/1936 | Bacigalupo | |
| 4,517,778 | A | | 5/1985 | Nicolai | |
| 4,718,206 | A | * | 1/1988 | Fyfe et al. | 52/167.8 |
| 4,883,250 | A | * | 11/1989 | Yano et al. | 248/638 |
| 4,917,211 | A | * | 4/1990 | Yamada et al. | 181/0.5 |
| 5,025,600 | A | * | 6/1991 | Sugimoto et al. | 52/167.1 |
| 5,261,200 | A | * | 11/1993 | Sasaki et al. | 52/167.5 |
| 5,452,548 | A | | 9/1995 | Kwon | |
| 5,573,220 | A | * | 11/1996 | Whittaker et al. | 248/638 |
| 5,599,106 | A | | 2/1997 | Kemeny | |
| 5,689,919 | A | * | 11/1997 | Yano | 52/167.6 |
| 5,716,037 | A | * | 2/1998 | Haak | 248/562 |
| 5,799,924 | A | * | 9/1998 | Slocum et al. | 248/636 |
| 5,934,029 | A | * | 8/1999 | Kawai et al. | 52/167.5 |
| 6,052,955 | A | * | 4/2000 | Haider | 52/167.5 |
| 6,092,780 | A | * | 7/2000 | Kurabayashi et al. | 248/636 |
| 6,123,313 | A | * | 9/2000 | Otsuka et al. | 248/580 |
| 6,164,022 | A | * | 12/2000 | Ishikawa et al. | 52/167.5 |
| 6,321,492 | B1 | * | 11/2001 | Robinson | 52/167.1 |
| 6,505,806 | B1 | * | 1/2003 | Glaesener | 248/638 |
| 6,725,612 | B2 | * | 4/2004 | Kim | 52/167.5 |
| 6,955,467 | B2 | * | 10/2005 | Chang et al. | 384/25 |
| 7,290,375 | B2 | * | 11/2007 | Kemeny | 52/167.1 |
| 2002/0166296 | A1 | * | 11/2002 | Kim | 52/167.5 |
| 2005/0100253 | A1 | * | 5/2005 | Chang et al. | 384/36 |
| 2006/0260221 | A1 | * | 11/2006 | Kemeny | 52/167.5 |
| 2008/0066398 | A1 | * | 3/2008 | Tubota | 52/167.5 |

FOREIGN PATENT DOCUMENTS

| | | |
|---|---|---|
| JP | 2000-240721 | 9/2000 |

OTHER PUBLICATIONS

Patent Abstract of Japan—Japanese Patent No. JP 2000-240721 published Sep. 5, 2000 (English translation).

* cited by examiner

ISOLATION PLATFORM

FIELD OF THE INVENTION

The present invention relates, generally, to isolation platforms for use in supporting various structures, and, more particularly, to platforms which isolate the structures they are supporting from ambient vibrations, generally external to the platform.

BACKGROUND OF THE INVENTION

Isolation bearings of the type used with bridges, buildings, machines, and other structures potentially subject to seismic phenomena are typically configured to support a bearing load, i.e., the weight of the structure being supported. In this regard, it is desirable that a particular seismic isolation bearing be configured to support a prescribed maximum vertical gravity loading at every lateral displacement position.

The conservative character of a seismic isolation bearing may be described in terms of the bearing's ability to restore displacement caused by seismic activity or other external applied forces. In this regard, a rubber bearing body, leaf spring, coil spring, or the like may be employed to urge the bearing back to its original, nominal position following a lateral displacement caused by an externally applied force. In this context, the bearing "conserves" lateral vector forces by storing a substantial portion of the applied energy in its spring, rubber volume, or the like, and releases this applied energy upon cessation of the externally applied force to pull or otherwise urge the bearing back to its nominal design position.

Known isolation bearings include a laminated rubber bearing body, reinforced with steel plates. More particularly, thin steel plates are interposed between relatively thick rubber plates, to produce an alternating steel/rubber laminated bearing body. The use of a thin steel plate between each rubber plate in the stack helps prevent the rubber from bulging outwardly at its perimeter in response to applied vertical bearing stresses. This arrangement permits the bearing body to support vertical forces much greater than would otherwise be supportable by an equal volume of rubber without the use of steel plates.

Steel coil springs combined with snubbers (i.e., shock absorbers) are often used in the context of machines to vertically support the weight of the machine. Coil springs are generally preferable to steel/rubber laminates in applications where the structure to be supported (e.g., machine) may undergo an upward vertical force, which might otherwise tend to separate the steel/rubber laminate.

Rubber bearings are typically constructed of high damping rubber, or are otherwise supplemented with lead or steel yielders useful in dissipating applied energy. Presently known metallic yielders, however, are disadvantageous in that they inhibit or even prevent effective vertical isolation, particularly in assemblies wherein the metallic yielder is connected to both the upper bearing plate and the oppositely disposed lower bearing plate within which the rubber bearing body is sandwiched.

Presently known seismic isolation bearings are further disadvantageous inasmuch as it is difficult to separate the viscous and hysteretic damping characteristics of a high damping rubber bearing; a seismic isolation bearing is thus needed which effectively decouples the viscous and hysteretic functions of the bearing.

Steel spring mounts of the type typically used in conjunction with machines are unable to provide energy dissipation, with the effect that such steel spring mounts generally result in wide bearing movements. Such wide bearing movements may be compensated for through the use of snubbers or shock absorbers. However, in use, the snubber may impart to a machine an acceleration on the order of or even greater than the acceleration applied to the machine due to seismicity.

For very high vertical loads, sliding type seismic isolators are often employed. However, it is difficult to control or maintain the friction coefficient associated with such isolators; furthermore, such isolators typically do not provide vertical isolation, and are poorly suited for use in applications wherein an uplift capacity is desired.

One example of an isolation bearing is one used to attempt to reduce the effects of noise by using a rolling bearing between rigid plates. For example, one such device includes a bearing comprising a lower plate having a conical shaped cavity and an upper plate having a similar cavity with a rigid ball-shaped bearing placed therebetween. The lower plate presumably rests on the ground or base surface to which the structure to be supported would normally rest, while that structure rests on the top surface of the upper plate. Thus, when external vibrations occur, the lower plate is intended to move relative to the upper plate via the rolling of the ball-shaped bearing within/between the upper and lower plates. The structure supported is thus isolated from the external vibrations.

However, such devices are not without their own drawbacks. For example, depending on their size, they may have a limited range of mobility. That is, the amount of displacement between the upper and lower plates may be limited based on the size of the bearing. Additionally, the bearing structures may be unstable by themselves. For example, when a large structure is placed on a relatively small bearing, it may become more likely that the structure could Up and/or fall over. Obviously, with very large, heavy structures, such failure could be catastrophic.

Similar to instability, the amount of load that any particular bearing structure can withstand can be limited by its size. Likewise, also related to the instability of the bearing, should the weight of the structure being supported be unevenly distributed, one section of either of the upper or lower plates may tend to bend or deflect more than another and the entire bearing structure could come apart.

Further still, often, when such large structures such as servers, electron microscopes, or other sensitive equipment are to be installed, the buildings and areas into which they are going to be installed are not easily configured to accommodate bearings such as those described above.

Thus, there is a long felt need for vibration isolation structures which can withstand more load, which are more stable (i.e., having less tendency to come apart) and are more easily integrated into the areas into which the structures for which they are intended are to be installed.

SUMMARY OF THE INVENTION

The present invention provides a platform for supporting various equipment and/or structure which assists in isolating such structure from vibrations ("noise") external to the platform. Generally, in accordance with various embodiments of the present invention, the platform comprises upper and lower plates, having conical depressions, upon which the upper plate supports the above-mentioned structure, and the lower plate contacting surface/area upon which the supported structure otherwise would have rested. Between the upper and lower plates, a plurality of rigid, spherical bearings are placed within the conical depressions, thereby allowing the upper and lower plates to displace relative to one another.

Thus, as lateral forces (e.g., in the form of vibrations) are applied to the platform, the upper plate is displaced laterally with respect to the lower plate, such that the balls therebetween roll about their respective depressions and the balls are raised to a higher elevations. As such, the gravitational forces acting on the structure produce a lateral force component tending to restore the entire platform to its original position. Thus, in accordance with the present invention, substantially constant restoring and damping forces are achieved.

In accordance with additional aspects of the present invention, stability of the platform is increased through the size of its "footprint" (its width versus its height) and/or various retaining mechanisms. For example, distances between the apices of the first open pan structure are preferably less than a ratio of 1.25 in relation to the height, width and/or depth of the payload. Additionally, preferably, half of the weight of the payload is in the upper portion half of the payload.

For example, various straps between the upper and lower plates may be attached, thereby allowing lateral displacement between the plates, but preventing unwanted separation of the plates. Additionally, in accordance with various embodiments of the present invention, the retaining mechanism (such as, for example, retaining straps) may provide additional damping effects. In accordance with further aspects of the present invention, various mechanisms may provide stability and damping effects, as well as contamination prevention, such as a rubber, foam, or other sealant (gasket) about the perimeter of the plates.

Likewise, in a preferred embodiment, an isolation platform for supporting a payload in accordance with the present invention comprises a first open pan structure having four plates with downward facing bearing surfaces, wherein the first open pan structure has a plurality of rigid members connected to the plates to form a quadrilateral. The first open pan structure has openings between each plate and each bearing surface comprising a recess with a central apex and a conical surface extending from the apex continuously to a perimeter of the recess, wherein distances between the apices of the recesses are at least equal to distances antipodal points of a footprint of the payload. A second open pan structure substantially identical to said first open pan structure is also provided and wherein said first and second open pan structures are positioned such that the bearing surfaces of the first and second open pan structures define four cavities therebetween, each cavity containing at least one rigid ball each, and wherein the first and second open pan structures are movably fastened together with straps that simultaneously limit displacement of the first open pan structure relative to the second open pan structure in a vertical plane and reduce displacement in a horizontal plane of the first open pan structure relative to the second open pan structure.

Further still, in accordance with various embodiments of the present invention, the first open pan structure moves in the horizontal plane without moving relative to the second open pan structure in the vertical plane by a factor, pre-selected factor, relating to the maximum possible horizontal displacement relative to the second pan. Similarly, the first open pan structure may be configured to move in the horizontal plane when the second open pan structure is moving at a rate of up to a pre-selected force without the first open pan structure moving more than a pre-selected distance in the horizontal plane and relative to the second open pan structure.

BRIEF DESCRIPTION OF THE DRAWING FIGURES

Additional aspects of the present invention will become evident upon reviewing the non-limiting embodiments described in the specification and the claims taken in conjunction with the accompanying figures, wherein like numerals designate like elements, and:

DETAILED DESCRIPTION OF EXEMPLARY EMBODIMENTS

Figure 1:
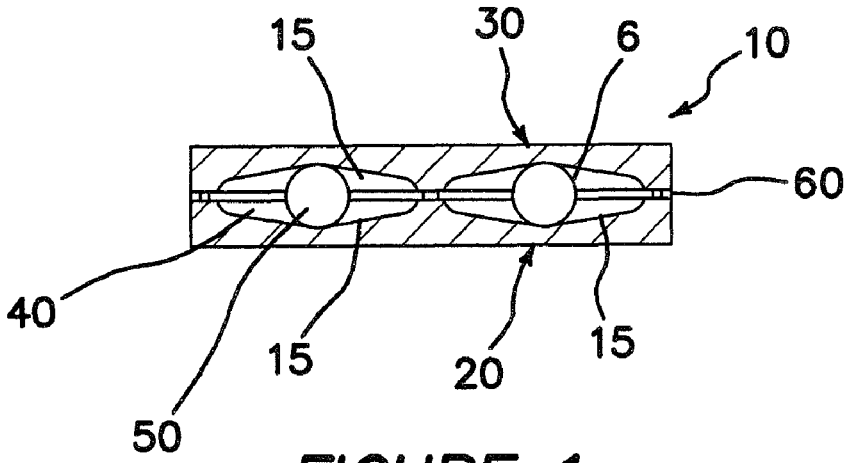
FIG. 1 is a cross-sectional view of an exemplary embodiment of an isolation platform in accordance with the present invention.

In accordance with various exemplary embodiments of the present invention, an isolation platform 10 is provided to filter vibrations and reduce noise in devices supported by platform 10. Preliminarily, it should be appreciated by one skilled in the art, that the following description is of exemplary embodiments only and is not intended to limit the scope, applicability, or configuration of the invention in any way. Rather, the following description merely provides convenient illustrations for implementing various embodiments of the invention. For example, various changes may be made in the design and arrangement of the elements described in the exemplary embodiments herein without departing from the scope of the invention as set forth in the appended claims.

That being said, generally, platform 10 comprises a lower plate 20 which is mounted to the foundation upon which the structure is intended to be supported. A second, oppositely disposed (upper) plate 30 is disposed above lower plate 20, and, optionally secured to the structure to be supported. In accordance with various embodiments, each of plates 20, 30 comprise a plurality of corresponding concave, generally conical surfaces (recessed surfaces) 15 which create a plurality of conical cavities 40 therebetween. Generally speaking, it should be appreciated that any suitable combination of radial or linear surfaces may be employed in the context of recesses 15 in accordance with the present invention. Additionally, platform 10 further comprises ball bearings 50, generally spherical steel ball bearings, disposed between plates 20, 30 in conical cavities 40.

More particularly, upper plate 30 supports the structure and has a plurality of downward-facing, conical, rigid bearing surfaces. Lower plate 20 is secured to a foundation (e.g., mechanically or by gravity and weight of platform 10 itself) for supporting the structure to be supported, and has a plurality of upward-facing, conical, rigid bearing surfaces disposed opposite downward-facing, conical, rigid bearing surfaces. Thus, the downward and upward bearing surfaces define a plurality of bearing cavities between said upper and lower plates, within which a plurality of rigid spherical balls are interposed between said downward and upward bearing surfaces.

With further particularity in the presently described exemplary embodiment, the downward and upward bearing surfaces comprise central apices having the same curvature as that of the rigid spherical balls such that a restoring force is substantially constant. Additionally, the surfaces have recess perimeters having the same curvature as that of the spherical balls and connect the central apices and recess perimeters with continuous slope. Thus, the curvature of the spherical balls and the downward and upward bearing surfaces are configured such that as the spherical balls and upper and lower plates displace laterally relative to one another, vertical displacement of upper and lower plates is near zero.

Thus, generally, when an external vibration such as a seismic dislocation or other ambient vibration exerts a lateral force on platform 10, plates 20, 30 move relative to each other, and balls 50 advantageously travel from an apex 25*a, b* of each plate 20, 30 toward the edge of cavities 40. When plates 20, 30 are laterally shifted with respect to one another from their nominal position, the weight of the structure supported by platform 10 exerts a downward force on upper plate 30; this bearing force is transferred through balls 50 to lower plate 20. Because of the inclined angle of recessed surfaces 15, a component of the vertical gravitational force exerted by the structure manifests as a lateral (e.g., horizontal) restoring force tending to urge plates 20, 30 back to their nominal position.

Figure 2:
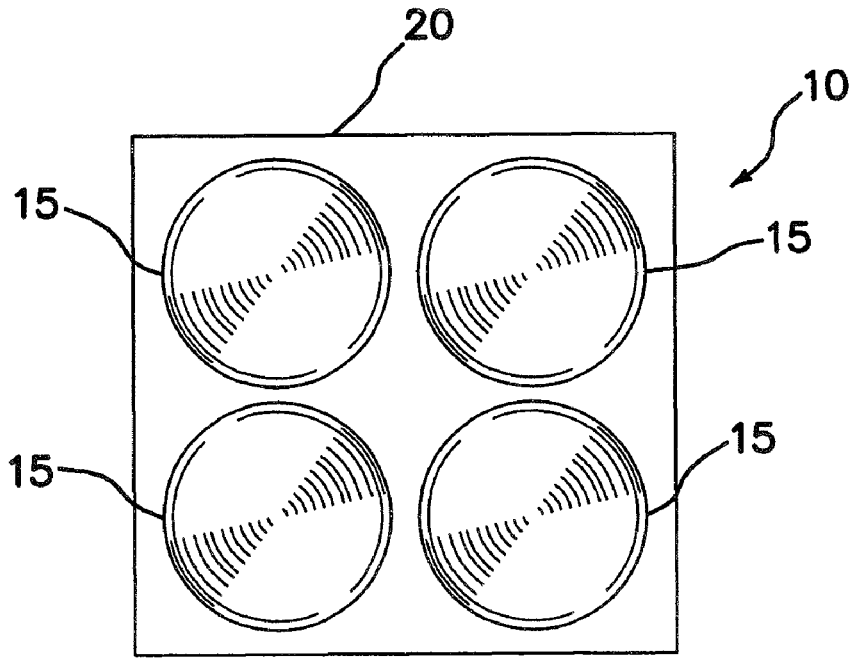
FIG. 2 is a top view of a lower plate in accordance with the embodiment of FIG. 1.

That being said, referring now to the exemplary embodiment illustrated in FIGS. 1 and 2, platform 10 suitably comprises upper plate 30 and lower plate 20 each comprising four recessed surfaces 15, characterized by an apex 25. Respective balls 50 are disposed in the intercavity region created by recessed surfaces 15. In their nominal position, balls 50 are suitably centered within their respective recesses 15, such that each ball 50 are disposed within its respective apices. In accordance with a further aspect of the present invention, the respective recesses 15 described herein may be suitably made from any high-strength steel or other material exhibiting high-yield strength. In addition, the various surfaces may be coated with Teflon or other protective layers to extend the life of platform 10, decrease friction between surface 15 and ball 50 and the like.

One advantage of a multiple cavity embodiment such as that described above, is that the capacity of platform 10 increases as the multiple of the number of recesses 15 increases. For example, a dual recess configuration is suitably twice as strong as a single recess configuration, whereas a four recess embodiment (such as shown in FIGS. 1 and 2) is suitably four times as strong in its capacity as a single ball configuration for equal materials and dimensions. Thus, though generally described herein with four recesses, platforms 10, in accordance with the present invention, may have any number and size of recesses used in any particular application to be configured to accommodate the desired bearing capacity of the load to be supported.

Referring particularly to FIG. 1, a gasket 60 may be suitably placed around a perimeter of plates 20, 30. Gasket 60 suitably comprises any material capable of elastically deforming as plates 20, 30 displace from one another, such as rubber or like material. In accordance with a preferred embodiment of the present invention, gasket 60 is adhered (e.g., glued) to one or both of plates 20, 30, preferably at the outer perimeter of plates 20, 30. Such gaskets 60 thus advantageously inhibit water, dust and debris, from entering the area between plates 20, 30. Additionally, in accordance with various aspects of the present invention, gasket 60 may provide additional damping effects.

Figure 3:
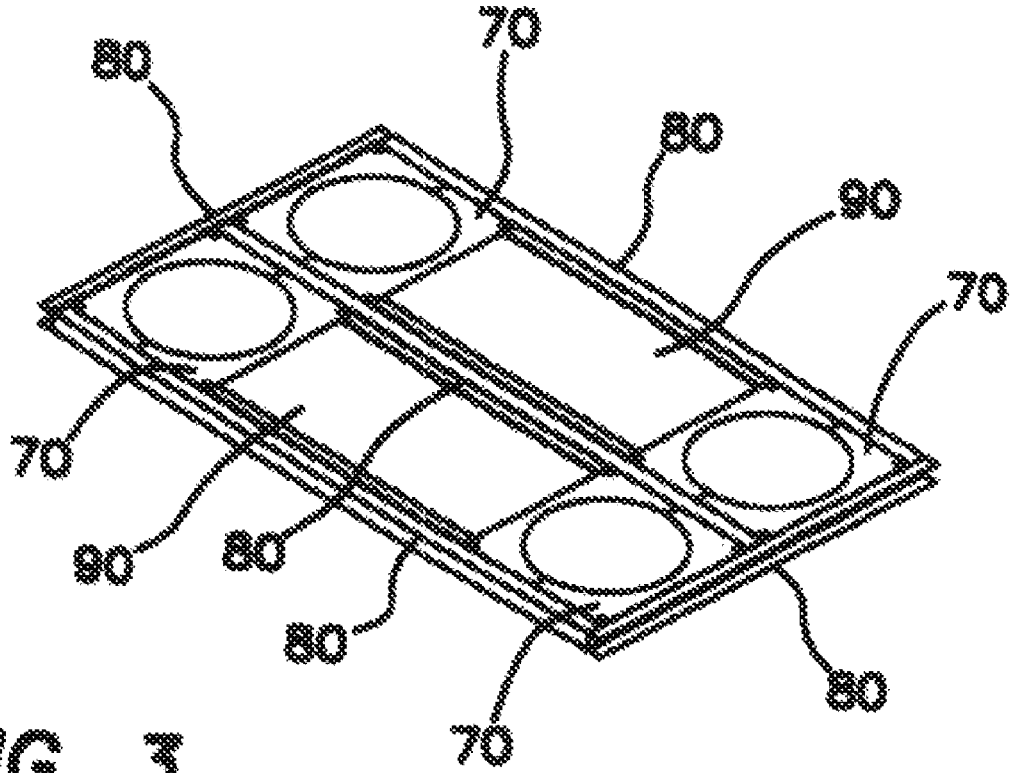
FIG. 3 is a perspective view of a load plate in accordance with an alternative embodiment of the present invention.

Now, in accordance with alternative exemplary embodiments of the present invention, platform 10 is configured in a manner which allows its dimensions to be adjustable and/or more lightweight. Referring particularly to FIG. 3, in accordance with another embodiment of the present invention, economical construction of plates 20, 30 may be achieved by affixing together a plurality of substantially flat, planar plate segments 70 with a series of connecting members 80. Plate segments 70 are suitably configured with recesses 15 such as those described above to provide bearing 50 contact and operation of platform 10 as described above when two plates are disposed on another.

Figure 4:
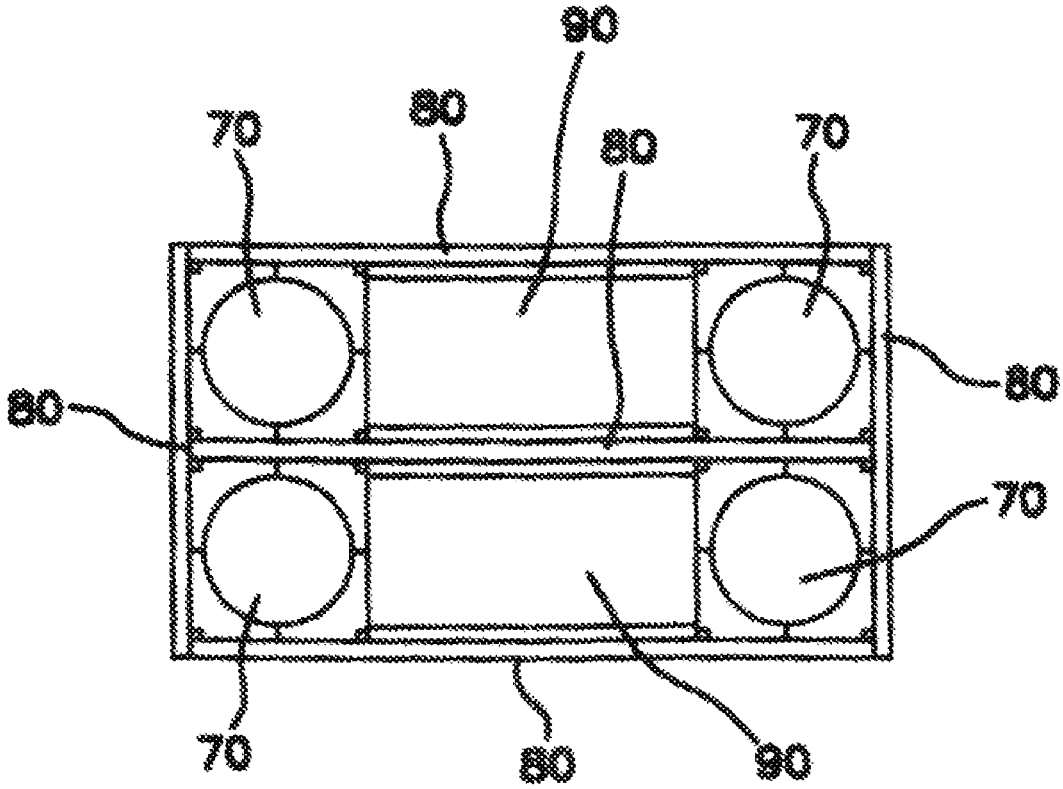
FIG. 4 is a top view of a load plate in accordance with an alternative embodiment of the present invention.

In accordance with the exemplary embodiment shown in FIGS. 3 and 4, connecting members 80 are attached to segments 70 in any manner suitably strong enough to withstand the vibrations of platform 10 experiences as well as the weight placed on platform 10. Similarly, the materials of segments 70 and members 80 should be strong enough to withstand the same. In the present exemplary embodiment, segments 70 are comprised of stainless steel and members 80 are comprised of A36 mild steel, though any materials exhibiting the aforementioned properties may be substituted.

Preferably, segments 70 and members 80 are attached via nut and bolt type fasteners, though alternative means of affixing them may include welding, brazing or the like. Advantages associated with bolting segments 70 and members 80 include the ability to disassemble plates 20, 30 and the ability to adjust the size of plates 20, 30 depending on where platform 10 is to be installed.

Optionally, in accordance with exemplary embodiment such as those shown in FIG. 3, the interstitial regions 90-created between respective segments 70 may be filled with a filler material, such as plastic, fabric, metal or the like (not shown), or alternatively may be left open. In the alternative, however, by leaving regions 90 open, access to the structure supported may be maintained Now, in accordance with various aspects of the above described embodiments of the present invention, when installed, upper plate 30 is preferably suitably anchored to the structure to be supported. Similarly, lower plate 20 is suitably mounted to a foundation upon which it rests. Likewise with upper plate 30, any number of means may be used to anchor lower plate 20, and likewise, the weight of platform 10 and/or structure may anchor lower plate 20. For example, in accordance with various embodiments of the present invention, lower plate 20 is placed in a recess in a tool room floor, thereby preventing lateral movement of the plate. In such a manner, the necessity of anchoring means such as bolts is eliminated.

With reference now to FIGS. 5-9, in accordance with various embodiments of the present invention, various mechanisms for retaining plates 20, 30 together may be provided. Retaining mechanisms 100 suitably prevent platform 10 from separating into its various components and/or provide additional damping effects.

Figure 5:
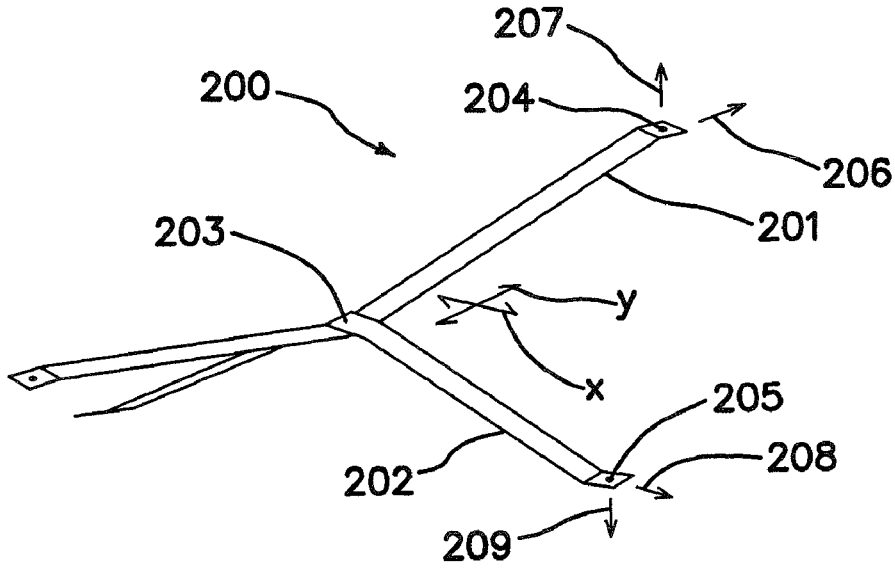
FIG. 5 is a perspective view of a strap configuration in accordance with an exemplary embodiment of the present invention.

For example with particular reference to FIG. 5, straps (in this case, nylon straps) 201 and 202 in the form of a tie down assembly 200 are engaged at contact point 203 during the displacement of the platform 10 (not shown for clarity). Strap 201 is attached at both ends (one end attachment is shown) to the upper portion of said platform, developing horizontal 206 and vertical 207 forces. Similarly, strap 202 is attached at both ends (one end attachment is shown) to the lower portion of said platform, developing horizontal 208 and vertical 209 forces. These forces thus suitably counterbalance seismic uplift and overturning forces of platform 10. Tie down assembly 200 is strategically located between bearings 50 of platform 10, which are preferably located at the far most corners of said platform. Thus assembly 200 is preferably tied between the sides of said platform about midway from corners. Assembly 200 allows for large x and y movement of said straps, without drop in the contact force, which pushes them together at point 203.

The contact force multiplied by the friction coefficient of straps 201, 202 give a lateral damping force, which attenuates the seismic motion of said platform. Said contact force is always parallel to forces 207, 209, while said damping force is with forces 206, 208, that is orthogonals.

Figure 6:
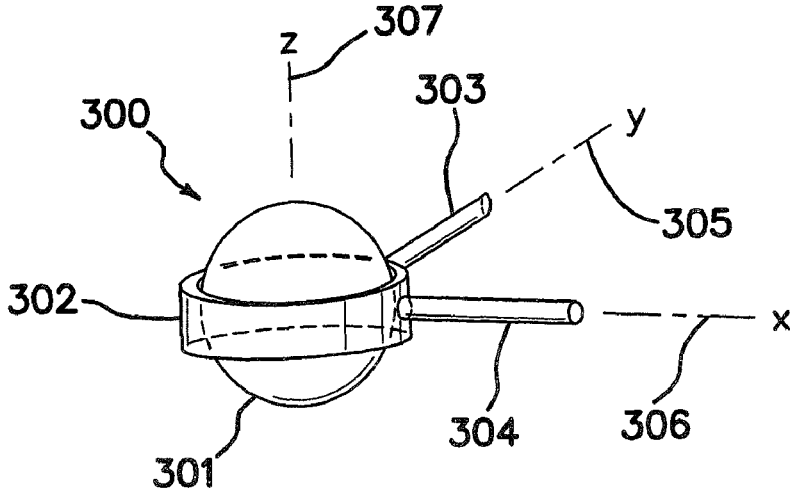
FIG. 6 is a perspective view of a "ball cage" configuration in accordance with an exemplary embodiment of the present invention.

In accordance with another embodiment of the present invention and with reference to FIG. 6, ball bearings 301 are retained laterally (relative to other balls) by a sleeve 302 (other balls are not shown for purposes of clarity). Connecting bars 303, 304 are suitably connected to sleeve 302. Bar 303 goes in direction 305, which is parallel to platform's 10 direction in the y-plane, thus allowing for "north/south" lateral bearing movements of platform 10. Bar 304 goes in direction 306, which is parallel to platform's 10 direction in the x-plane, thus allowing for "east/west" bearing movements of platform 10. Moreover, during such lateral movement of said platform, cage 300 may rotate, thus direction y may not coincide with direction 305 and direction x may not coincide with direction 306. However, the angle between directions 305, 306 remains the same, for example, 90° as well as between x and y. Cage 300 thus ensures that the stationary position 307 of any ball caged by cage 300 remains the same relative to any other ball in the same cage, but not to the ground and to the payload imposed on said platform. Moreover, as the load comes from direction z, that is vertically to ball 301, cage 300 ensures that when one or more of the load on any balls caged by cage 300 is missing (e.g., due to uplift), the unloaded balls will not roll out of alignment during seismic movement of said platform.

Figure 7:
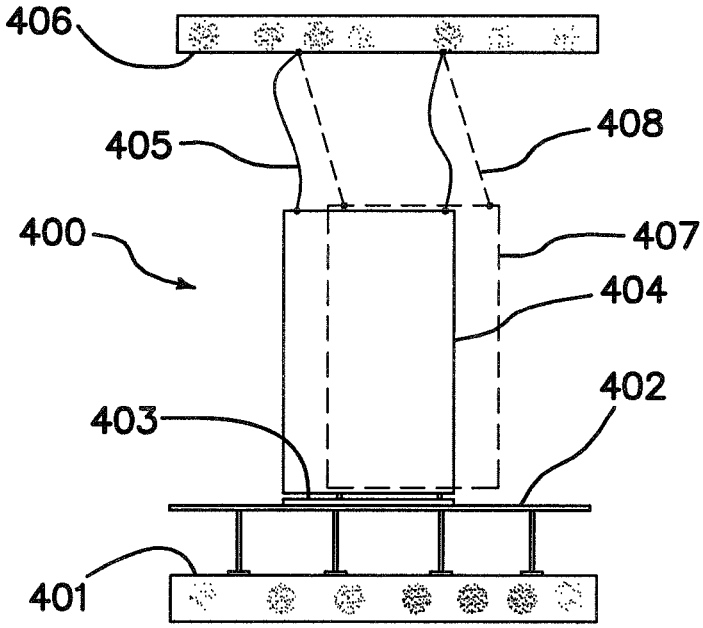
FIG. 7 is a side view of an equipment restrainer in accordance with an exemplary embodiment of the present invention.

In accordance now with still another embodiment of the present invention, and with reference to FIG. 7, a floor 401 supports an access floor 402, which in turn supports platform 403. As described above, equipment 404 rests on platform 403 and is suitably restrained with cable ties 405 to an upper support 406, such as, for example a ceiling. Thus, during seismic floor motion, equipment 404 can displace to position 407, whereupon ties 405 (restrainers) became taught 408, preventing overturning of equipment 404.

Figure 8:
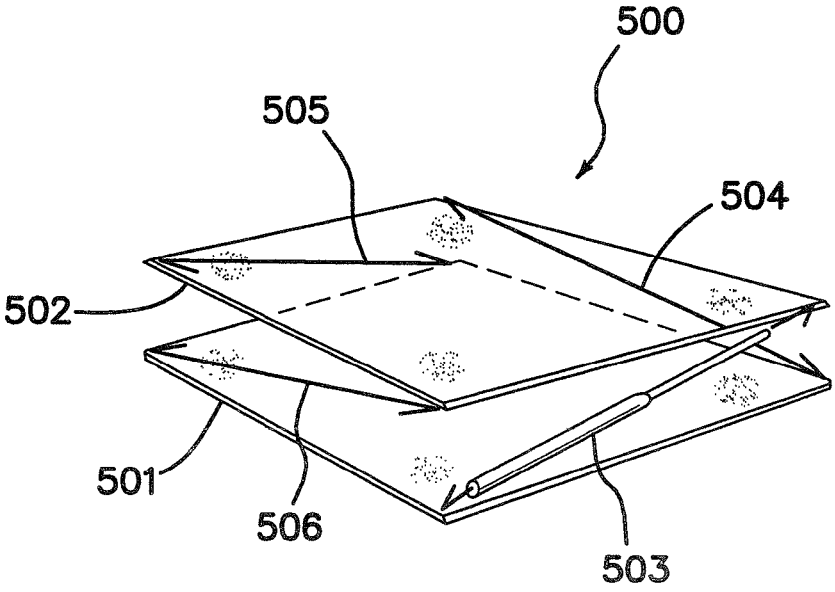
FIG. 8 is a side view of an exemplary embodiment of the present invention having a telescoping damper assembly.

In accordance with yet another embodiment of the present invention and with reference to FIG. 8, a lower frame 501 rests on isolation bearings (not shown for clarity) on an upper frame 502. Frames 501, 502 combined with bearings (not shown for clarity) thus form platform 10. Telescopic dampers 503, 504, 505 and 506 connect frames 501, 502 at their respective corners. In various embodiments, dampers 503, 504, 505, 506 may be air, hydraulic or friction type dampers generally having small force and long strokes and are strategically located between the ball bearings of said platform. In the illustrated embodiment, dampers 503 and 505 damp in an x-direction, while dampers 504, 506 damp in a y-direction. Thus, in combination dampers 503, 504, 505, 506 provide torsional damping to platform 10.

Figure 9:
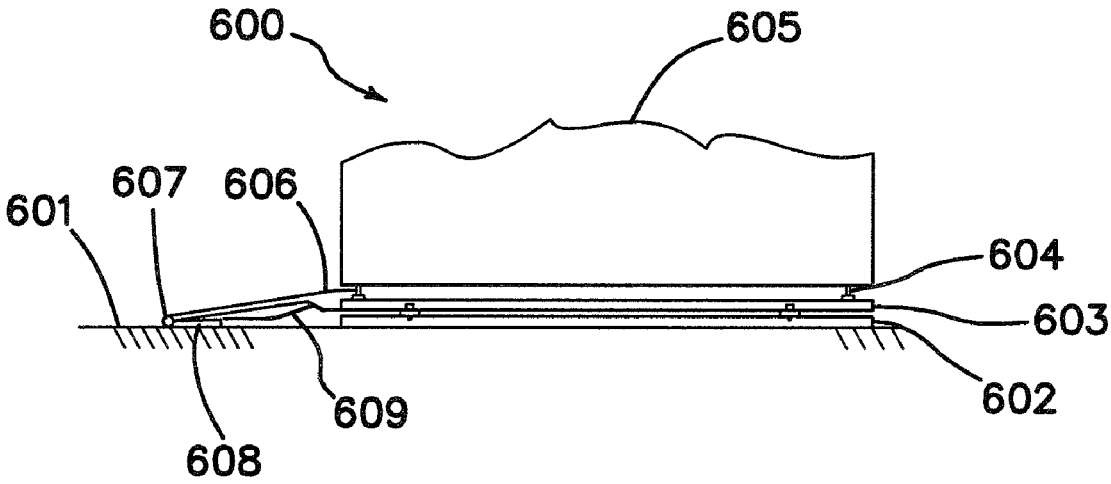
FIG. 9 is a side view of an exemplary embodiment of the present invention having an "out-rigger" damper assembly.
Figure 10:
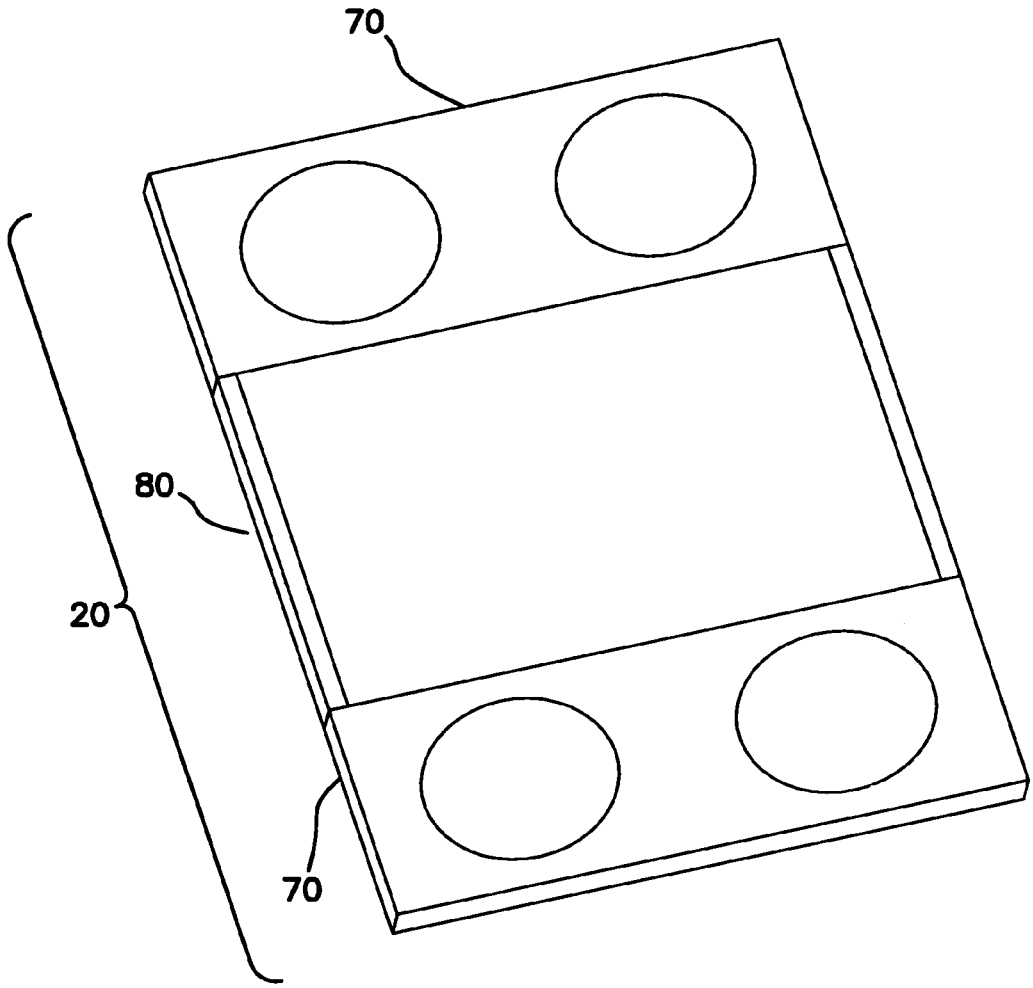
FIG. 10 is a side view of an exemplary embodiment of the present invention having a dual recess configuration.

In accordance with another embodiment of the present invention and with reference to FIG. 9, an "outrigger" damper assembly 600 is provided. In this embodiment, a smooth floor 601, upon which platform may slide is provided to support platform base 602 with its ball bearings. A platform top 603 rides on the ball bearings and receives an equipment leg 604, which in turn supports equipment 605. An outrigger plate 606 is suitably hinged to one of platform top 603 or to leg 604 and suitably rides over floor 601. In accordance with various aspects of this embodiment, to assist in controlled friction forces for added damping, a plate 608 is hinged to outrigger plate 606. Plate 608 is pushed down by a spring force, for example, by a leaf spring 609. In this embodiment, the surface of plate 608 is lined to optimize friction force between outrigger 606 and floor 601 during seismic movement of the assembly. Of course, in various embodiments, the weight of equipment alone may be sufficient to provide for friction control, in which case, spring assistance is not needed. Thus, outrigger plate 606 assists in providing stability to equipment 605.

I claim:

1. An isolation platform comprising:

an upper plate upon which equipment to be supported is placed, said upper plate having a plurality of downward-facing, conical, rigid bearing surfaces linked by connecting members affixed along one or more edge of each said bearing surface;

a lower plate secured to a foundation, said foundation supporting the isolation platform and the equipment to be supported, said lower plate having a plurality of upward-facing, conical, rigid bearing surfaces linked by connecting members affixed along one or more one edge of each said bearing surface and disposed opposite said downward-facing, conical, rigid bearing surfaces, said downward and upward bearing surfaces defining a plurality of bearing cavities between said upper and lower plates;

a plurality of rigid spherical balls interposed between said downward and upward bearing surfaces;

said downward and upward bearing surfaces comprising central apices having the same curvature as that of said spherical balls, and having recess perimeters having the same curvature as that of said spherical balls, which connects said central apices and recess perimeters with continuous slope, wherein the curvature of said spherical balls and downward and upward bearing surfaces are further configured such that as said spherical balls and upper and lower plates displace laterally relative to one another, a restoring force damping continued movement of the plates is substantially constant;

structured so that, in response to an external vibration, said lower plates are displaced laterally with respect to said upper plates such that the rigid spherical balls therebetween roll about their respective bearing surfaces and are raised to higher elevations, the platform further comprising a retention mechanism securing said lower plate and said upper plate together that allows for lateral displacement between said upper and lower plates without separation of said upper and lower plates.

2. The isolation platform of claim 1, further comprising a resiliently deformable gasket interposed between said upper and lower plates.

3. The isolation platform of claim 1, wherein said upper plate comprises a plurality of upper plate segments attached to a plurality of corresponding upper connecting members which define said upper plate and further define a plurality of upper interstitial regions.

4. The isolation platform of claim 1, wherein said lower plate comprises a plurality of lower plate segments attached to a plurality of corresponding lower connecting members which define said lower plate and further define a plurality of lower interstitial regions.

5. The isolation platform of claim 1 wherein the equipment is sensitive.

6. The isolation platform of claim 1 wherein the equipment is a server.

7. The isolation platform of claim 1 wherein the equipment is an electron microscope.

8. An apparatus comprising a combination of:

a) an isolation platform and b) a payload comprising equipment to be supported thereupon, where the isolation platform comprises:

a first structure having four or more plates having downward facing bearing surfaces and linked by connecting members affixed along one or more edge of each said bearing surface, each bearing surface comprising a steel recessed surface optionally coated with a protective layer with a central apex and a conical surface extending from said central apex continuously to a perimeter of said recess, wherein distances between said apices of said recesses are at least equal to distances antipodal points of a footprint of the payload; a second structure wherein said first and second structures are positioned such that said bearing surfaces of said first and second structures define said four or more cavities therebetween, each cavity containing at least one rigid ball, structured so that in response to an external vibration, the plates of the first structure are displaced laterally with respect to the plates of the second structure such that the rigid balls therebetween roll about their respective bearing surfaces and are raised to higher elevations and a restoring force damping continued movement of the plates is substantially constant, wherein said first structure and said second structure are movably fastened together in a manner that simultaneously limits displacement of said first structure relative to said second structure in a vertical plane and reduces displacement in a horizontal plane of said first structure relative to said second structure.

9. The isolation platform of claim 8, wherein said first structure further comprises a payload securing device on a top surface of said first structure.

10. The isolation platform of claim 8, wherein said first and second structures are open on one longitudinal end allowing access to cables.

11. The isolation platform of claim 8 wherein the equipment is sensitive.

12. The isolation platform of claim 8 wherein the equipment is a server.

13. The isolation platform of claim 8 wherein the equipment is an electron microscope.

14. An apparatus comprising a combination of:

a) an isolation platform and b) a payload comprising equipment to be supported thereupon, where the isolation platform comprises: a first open pan structure having four or more plates having downward facing bearing surfaces and linked by connecting members affixed along one or more edge of each said bearing surface, wherein said first open pan structure forms a quadrilateral, said first open pan structure having openings between plates, each bearing surface comprising a steel recessed surface optionally coated with a protective layer with a central apex and a conical surface extending from said central apex continuously to a perimeter of said recess, wherein distances between said apices of said recesses are at least equal to distances antipodal points of a footprint of the payload; a second open pan structure having the same number of upward facing bearing surfaces linked by connecting members affixed along one or more edge of each said bearing surface as said four or more plates having downward bearing surfaces and wherein said first and second open pan structures are positioned such that said bearing surfaces of said first and second open pan structures define four or more cavities therebetween, each cavity containing at least one rigid ball, structured so that in response to an external vibration, the plates of the first open pan structure are displaced laterally with respect to the plates of the second open pan structure such that the rigid balls therebetween roll about their respective bearing surfaces and are raised to higher elevations, wherein a restoring force damping continued movement of the plates is substantially constant and, wherein said first pan structure and said second open pan structure are movably fastened together in a manner that simultaneously limits displacement of said first open pan structure relative to said second open pan structure in a vertical plane and reduces displacement in a horizontal plane of said first open pan structure relative to said second open pan structure.

15. The isolation platform of claim 14 wherein the equipment is sensitive.

16. The isolation platform of claim 14 wherein the equipment is a server.

17. The isolation platform of claim 14 wherein the equipment is an electron microscope.

18. An isolation platform comprising:

two or more substantially flat substantially planar first plate segments, each said first plate segment comprising a first side and a second side opposite said first side comprising at least two upward facing recesses comprising a combination of radial and linear bearing surfaces;

two or more substantially flat substantially planar second plate segments, each said second plate segment comprising a first side and an opposite second side comprising at least two downward facing recesses comprising a combination of radial and linear bearing surfaces; and two or more laterally affixed connecting members linking the two or more first plate segments wherein said first plate segment bearing surfaces are linked by connecting members affixed along one or more edge of each said bearing surface, and two or more laterally affixed connecting members linking the two or more second plate segments wherein said second plate segment bearing surfaces are linked by connecting members affixed along one or more edge of each said bearing surface;

said two or more first plate segments facing said two or more second plate segments, the opposing recesses between individual said first plate segments and said second plate segments defining at least two cavities therebetween, each cavity containing at least one rigid ball therebetween;

wherein in response to an external vibration, the two or more first plate segments are displaced laterally with respect to the two or more second plate segments such that the rigid balls therebetween roll about their respective bearing surfaces, thereby raising the balls and/or bearing surfaces to a higher elevation, and wherein a restoring force damping continued movement of the plates is substantially constant.

19. The isolation platform of claim 18 wherein at least a pair of laterally affixed connecting members linking said first plate segments or said second plate segments are parallel to each other.

20. The isolation platform of claim 18 wherein the connecting members link the plate segments via nuts and bolts.

21. The isolation platform of claim 18 that is structured such that a payload comprising equipment to be supported is placed on the first side of said two or more second plate segments.

22. The isolation platform of claim 18 wherein a restraining device is attached between said two or more second plate segments and said payload comprising equipment to be supported.

23. The isolation platform of claim 18 wherein the open space between two or more of said first plate segments or the two or more of second plate segments allows access to cables.

* * * * *